US005875154A

United States Patent [19]

Dechico

[11] Patent Number: 5,875,154

[45] Date of Patent: Feb. 23, 1999

[54] BARREL STAVE FLEXTENSIONAL PROJECTOR

[75] Inventor: Robert A Dechico, Pennington, N.J.

[73] Assignee: The United States of America as represented by the Secretary of the Navy, Washington, D.C.

[21] Appl. No.: 970,165

[22] Filed: Nov. 13, 1997

[51] Int. Cl.[6] ..... H04R 17/00

[52] U.S. Cl. ..... 367/163; 367/141; 367/157; 367/174; 310/337

[58] Field of Search ..... 310/337; 367/157, 367/163, 174, 141

[56] References Cited

U.S. PATENT DOCUMENTS

| | | | |
|---|---|---|---|
| 4,864,548 | 9/1989 | Butler | 367/155 |
| 4,922,470 | 5/1990 | McMahon et al. | 367/163 |
| 5,136,556 | 8/1992 | Obara | 367/163 |

*Primary Examiner*—Ian J. Lobo

*Attorney, Agent, or Firm*—Ron Billi

[57] ABSTRACT

An apparatus for producing an acoustic output in an underwater environment includes a radiator having a generally elongate, circular x-section with first and second ends, the outer surface of the radiator having a curved shape; an end cap attached to each end of the radiator; and a plurality of piezoceramic elements positioned and arranged to form stacks located exterior to the radiator and between the end caps. The radiator and the end caps seal off the interior of the radiator and provide an air tight cavity interior to the radiator. When a fluctuating voltage is applied across the piezoceramic stacks, the stacks are caused to longitudinally expand and contract in concert with the applied voltage thus inducing a displacement of the end caps. Since the ends of the radiator are attached to the end caps, the radiator is caused to flex inwardly and outwardly as the end caps move longitudinally. The present invention provides a greater specific power output; a useful, dry space interior to the radiator; and enhanced cooling of the piezoceramic elements.

16 Claims, 4 Drawing Sheets

BARREL STAVE FLEXTENSIONAL PROJECTOR

The present invention relates to acoustic transducers for use in an underwater environment. More specifically, but without limitation, the present invention relates to a barrel stave flextensional transducer having piezoelectric elements for producing an acoustic output in an underwater environment.

It is often desirable to generate underwater sound waves for the purpose of detecting submarines, ships, land masses, bottom contours, and other objects not immediately detectable by other means. Such "sonar" systems generate sound waves which are reflected back to the source after impacting an object. When received, the reflected waves may indicate the presence of an underwater object, its distance from the source, and its speed and direction of travel, for example. The more powerful the generated acoustic output, the greater the detection range and the greater the probability of detection.

Various types of acoustic generators, called "projectors", have been developed. One such type is the so called "barrel stave flextensional" projector. This device has a generally elongate, circular x-sectional shape, with major diameters at both ends and a minor diameter approximately midway between the ends. Each end includes an end cap in the form of a circular disc. The sides thus describe a concave surface and are formed by positioning preshaped aluminum staves around the circumference of the end caps. The staves are attached to the end caps at each end. A water impervious boot, such as neoprene, is attached to the outer, concave surface of the staves and to the end caps to prevent water from penetrating the gaps located between adjacent staves. Piezoceramic elements, in the form of rings, discs or the like, are arranged to form a stack inside the staves and are attached to the end caps at each end. When a fluctuating voltage is applied across the piezoceramic stack, the piezoceramic elements are caused to longitudinally expand and contract in concert with the applied voltage thus inducing longitudinal displacement of the end caps. Since the staves are attached to the end caps, the staves are caused to flex inwardly and outwardly as the end caps move longitudinally. The flexing staves couple with the water, through the neoprene boot, generating an acoustic sound.

It can thus be seen that the barrel stave flextensional projector functions as a mechanical multiplier by converting the relatively small longitudinal displacement of the piezoceramic stack to a considerably larger radial displacement of the staves. This mechanical advantage may be improved by increasing the ratio of the concave surface area to the height (i.e. longitudinal dimension) of the piezoceramic stack. For example, the curvature of the staves may be increased by increasing the diameter to height ratio. However, for any given diameter to height ratio, the mechanical advantage is ultimately limited by the staves degree of curvature, that is, the flexing staves must not contact the piezoceramic stack. Power handling is thus limited. Alternatively, the diameter of the piezoceramic stack may be decreased thus permitting an increase in the curvature of the staves but power handling will still be decreased due to power loss in the piezoceramic stack.

Thus, there is a need in the art to provide an improved acoustic projector that incorporates the beneficial characteristics of the barrel stave flextensional projector without the limitations inherent in present designs.

SUMMARY OF THE INVENTION

Accordingly, the preferred embodiment of the present invention includes a radiator having a generally elongate, circular x-section with first and second ends, the outer surface of the radiator having a generally concave shape with major diameters located adjacent each end and a minor diameter located approximately midway between the ends. The first end of the radiator is attached to a first end cap and the second end of the radiator is attached to a second end cap, both end caps having a circular shape. A plurality of stacks of piezoceramic elements are positioned and arranged around the radiator and between the end caps. The radiator may include a plurality of staves and a water impervious boot (i.e. cover) to prevent water infiltration into the interior of the boot or a one piece, preshaped water impervious fabric such as kevlar and Teflon.

When a fluctuating voltage is applied across the piezoceramic stacks, the piezoceramic stacks are caused to longitudinally expand and contract in concert with the applied voltage thus inducing longitudinal displacement of the end caps. Since the ends of the radiator are attached to the end caps, the radiator is caused to flex inwardly and outwardly as the end caps move longitudinally. The present invention: permits a greater quantity of piezoceramic to be used for a given projector size; permits a larger radiator surface area to be used for a given projector area; provides a useful space, interior to the radiator, to house, for example, an electronics package or tuning coil; and provides enhanced cooling of the piezoceramic rings due to immersion in sea water. As a result, the present invention can achieve a greater specific acoustic output than previous barrel stave flextensional projectors.

Accordingly, it is an object of the present invention to provide an apparatus having increased specific power output.

It is another object of the present invention to provide an apparatus having a greater quantity of piezoceramic material.

It is a further object of the present invention to provide an apparatus having a greater ratio of radiator surface area to piezoceramic stack height.

It is also an object of the present invention to provide an apparatus with increased cooling of the piezoceramic elements.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
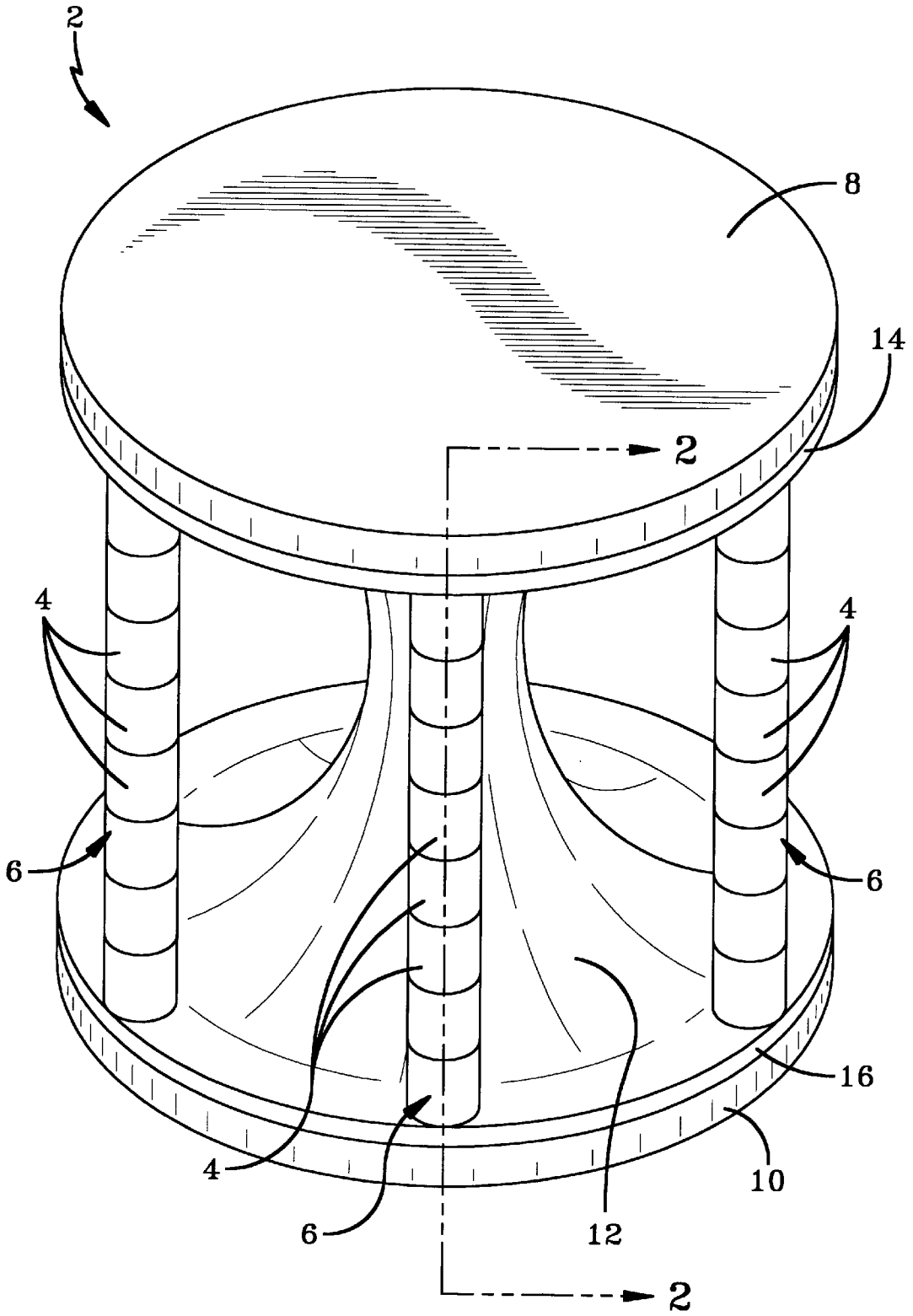
FIG. 1 is a perspective view of the present invention.
Figure 2:
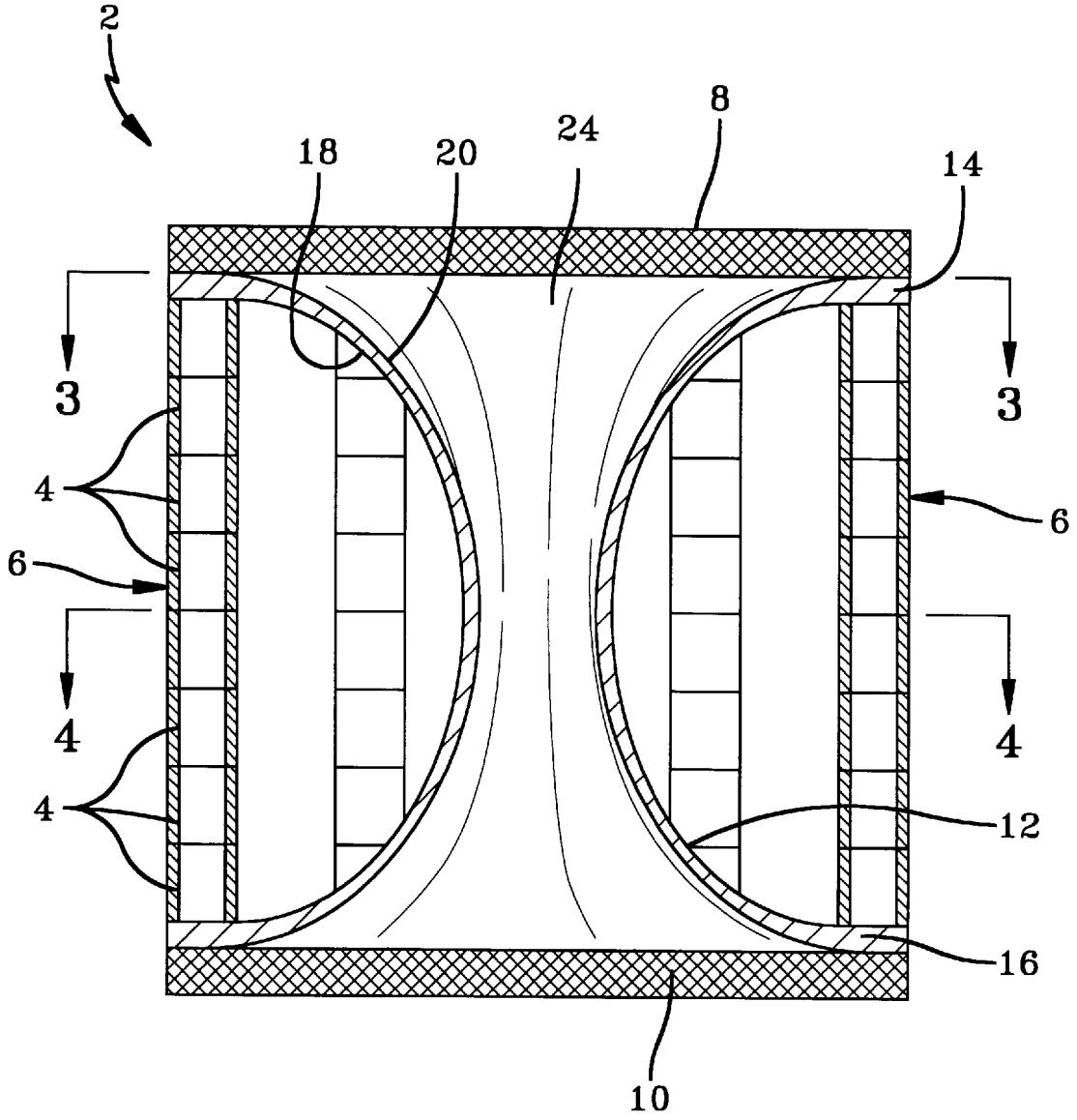
FIG. 2 is a x-section of the present invention taken through section 2—2 of FIG. 1.
Figure 3:
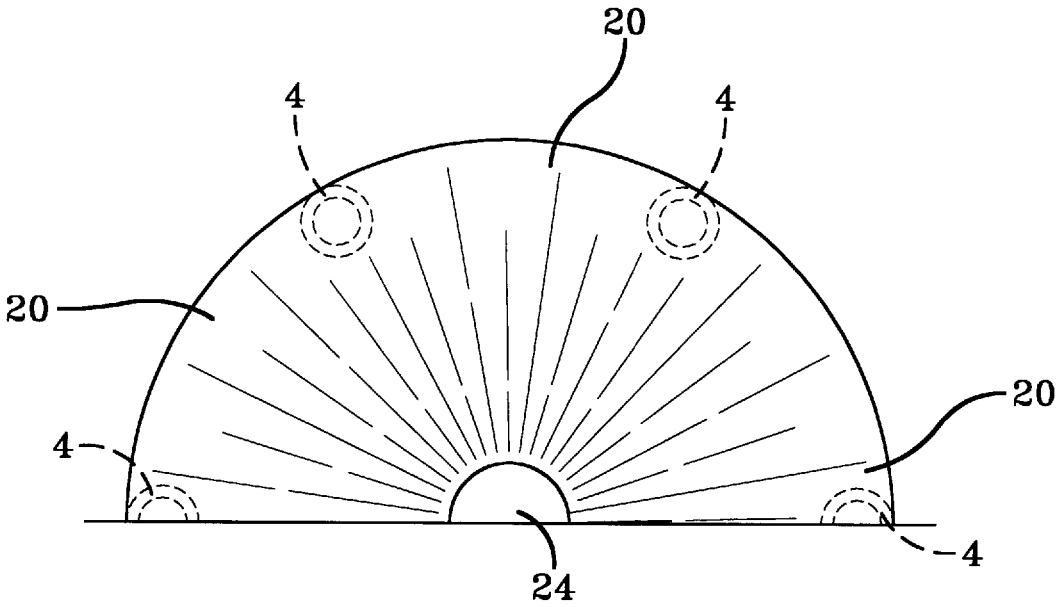
FIG. 3 is a x-section of the present invention taken through section 3—3 of FIG. 2.
Figure 4:
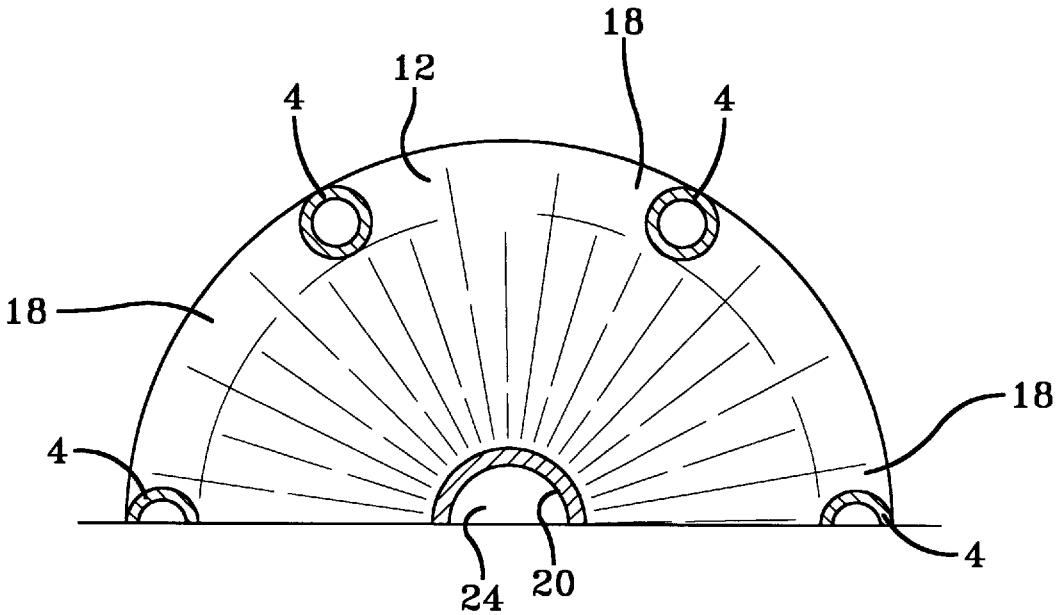
FIG. 4 is a x-section of the present invention taken through section 4—4 of FIG. 2.

The preferred embodiment of the present invention is illustrated by way of example in FIGS. 1–4. As shown in FIGS. 1 and 2, projector 2 includes a plurality of piezoceramic elements 4, such as rings or discs, having piezoelectric properties. Such properties cause certain materials, such as, ceramic crystals to become electrically polarized when mechanically strained and conversely to exhibit a strain from the application of an electric field. The properties and operation of such piezoceramic rings are well known by those skilled in the art. A plurality of piezoceramic elements 4 are positioned and arranged to form stacks 6. Each stack 6 is located between end caps 8 and 10. In the preferred embodiment, there are 6 stacks located exterior to radiator 12 and equally spaced around the circumference of end caps 8 and 10. However any number of stacks may be employed from as few as 3 stacks up to 6 or more stacks. Adjacent elements 4 are attached. Note that rings 4 are in contact with the water medium in which projector 2 operates.

In the preferred embodiment, radiator 12 forms a generally concave outer surface 18 with major diameters located at both first end 14 and second end 16, and a minor diameter located approximately midway therebetween. Radiator 12 also includes inner surface 20 and outer surface 18 and in the preferred embodiment is impermeable. First end 14 is attached to end cap 8 and second end 16 is attached to end cap 10. Radiator 12 is preferably pre-formed from a high strength, composite fabric such as kevlar and Teflon thus providing low mass, high stiffness and water impermeability. Radiator 12 may have other shapes. In conjunction with impermeable radiator 12, end caps 8 and 10 seal off cavity 24 thereby providing an airtight space interior to radiator 12. Such cavity 24 may be used, for example, to house an electronics package or tuning coil.

As shown in FIG. 2, first end 14 is located between end cap 8 and elements 4 on one end and second end 16 is located between end cap 10 and elements 4 on the other end. It should be noted that radiator 12 is subject to inwardly acting hydrostatic forces when submerged.

Figure 5:
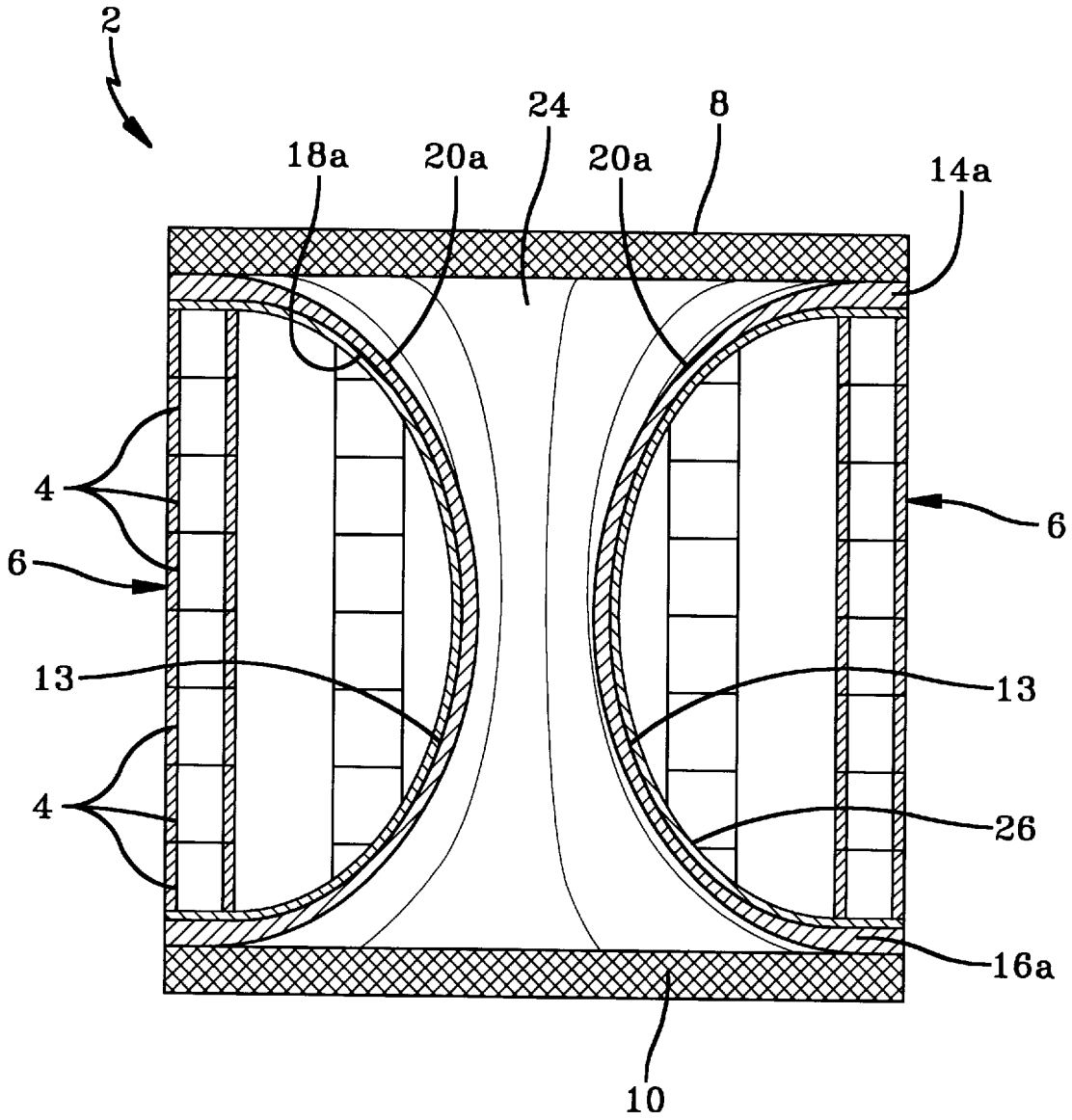
FIG. 5 is an alternate embodiment of the present invention showing a radiator having aluminum staves and a water impervious cover.

Radiator 12 may also be formed from a plurality of staves 13 positioned and arranged to form, preferably, a generally concave outer surface 18*a* with major diameters located at both first end 14*a* and second end 16*a*, and a minor diameter located approximately midway therebetween (see FIG. 5). Each stave 13 also includes inner surface 20*a*. First end 14*a* of each stave 13 is attached to end cap 8 and second end 16*a* of each stave is attached to end cap 10. Staves 13 are preferably formed from prestressed aluminum. Cover 26 is located on the outside of staves 13 to prevent infiltration of water through gaps 22 to interior 24 of projector 2. In the preferred embodiment, cover 26 is fabricated from a water impervious material such as neoprene. Other synthetic rubbers may also be used. In conjunction with cover 26, end caps 8 and 10 seal off cavity 24 thereby providing an airtight space interior to staves 13. Such cavity 24 may be used, for example, to house an electronics package or tuning coil.

As shown in FIG. 5, first end 14a and cover 26 are located between end cap 8 and stack 6 on one end and second end 16*a* and cover 26 are located between end cap 10 and stack 6 on the other end. It should be noted that cover 26 is subject to inwardly acting hydrostatic forces which are in turn transferred, via cover 26, to staves 12.

It should be understood that projector 2 may include stacks 6 in conjunction with either staves, preferably of aluminum, or fabric, preferably of kevlar and Teflon.

It can now be understood by those skilled in the art that when a fluctuating voltage is applied across the stacks 6 of piezoceramic elements 4, the stacks of elements are caused to longitudinally expand and contract in concert with the applied voltage thus inducing longitudinal displacement of end caps 8 and 10. Since each end of radiator 12 is attached to one end cap, the curvature of radiator 12 is caused to decrease (i.e. straighten out) when elements 4 increase in length. Conversely, the curvature of radiator 12 is permitted to increase (i.e. become more concave) when elements 4 decrease in length. The resulting movement of radiator 12 produces an acoustic output.

Obviously, many modifications and variations of the present invention are possible in light of the above teachings. It is therefore to be understood, that within the scope of the appended claims, the invention may be practiced otherwise than as specifically described.

What is claimed is:

1. An apparatus for producing an acoustic output in an underwater environment when a fluctuating voltage is applied, comprising:

a) a radiator having a curved outer surface and a first end and a second end;

b) a first end cap attached to the first end of the radiator;

c) a second end cap attached to the second end of said radiator; and d) a plurality of piezoceramic stacks, the stacks located exterior to said radiator and between said end caps;

wherein said piezoceramic stacks expand and contract in a longitudinal direction when said fluctuating voltage is applied across said stacks and said radiator is caused to be radially displaced and generate an acoustic output.

2. The apparatus defined in claim 1, wherein the curved outer surface of said radiator is concave and includes major diameters located at both said first and said second ends and a minor diameter located therebetween.

3. The apparatus defined in claim 2, wherein the number of piozoceramic stacks is from three to six.

4. The apparatus defined in claim 1, wherein said radiator is a one piece, water impervious fabric.

5. The apparatus defined in claim 4, wherein the one piece, water impervious fabric is preshaped.

6. The apparatus defined in claim 2, wherein said radiator is a one piece, water impervious fabric.

7. The apparatus defined in claim 6, wherein the one piece, water impervious fabric is preshaped.

8. The apparatus defined in claim 1, wherein said end caps seal off said radiator to form an air tight cavity interior to said radiator.

9. The apparatus defined in claim 8, wherein said radiator is concave and includes major diameters located at both first and said second ends and a major diameter located therebetween.

10. The apparatus defined in claim 9, wherein said radiator is a one piece, water impervious fabric.

11. The apparatus defined in claim 10, wherein the one piece, water impervious fabric is preshaped.

12. The apparatus defined in claim 1, wherein said radiator is formed from a plurality of staves positioned and arranged to form a generally concave outer surface with major diameters located at both said first and said second ends and a minor diameter located therebetween and further including a cover located on the outside of said staves to prevent the infiltration of water between adjacent staves.

13. The apparatus defined in claim 12, wherein said staves are aluminum.

14. The apparatus defined in claim 13, wherein said cover is synthetic rubber.

15. The apparatus defined in claim 14, wherein said cover is neoprene.

16. An apparatus for producing an acoustic output in response to an applied voltage, comprising:

a) first means for receiving the applied voltage and expanding and contracting in a longitudinal direction and in concert with the applied voltage;

b) second means, operatively attached to said first means, for moving in response to the expanding and contracting of said first means, said second means moving in a radial direction, and said first means located exterior to said second means;

c) third means for sealing off an airtight cavity interior to said second means.

* * * * *